US006439016B1

(12) United States Patent
Wittwer et al.

(10) Patent No.: US 6,439,016 B1
(45) Date of Patent: Aug. 27, 2002

(54) CLOSING DEVICE FOR CLOSING FUNCTIONS IN VEHICLES IN PARTICULAR

(75) Inventors: Reinhard Wittwer, Heiligenhaus; Mathias Löw, Ratingen, both of (DE)

(73) Assignee: Huf Hülsbeck & Fürst GmbH & Co., KG, Velbert (DE)

( * ) Notice: Subject to any disclaimer, the term of this patent is extended or adjusted under 35 U.S.C. 154(b) by 0 days.

(21) Appl. No.: 09/701,409

(22) PCT Filed: May 20, 1999

(86) PCT No.: PCT/EP99/03447

§ 371 (c)(1),
(2), (4) Date: Nov. 28, 2000

(87) PCT Pub. No.: WO99/63187

PCT Pub. Date: Dec. 9, 1999

(30) Foreign Application Priority Data

May 30, 1998 (DE) ..... 198 24 398
Nov. 20, 1998 (DE) ..... 198 53 543

(51) Int. Cl.[7] ..... E05B 17/04
(52) U.S. Cl. ..... 70/379 R; 70/386; 70/422
(58) Field of Search ..... 70/386, 379 R, 70/379 A, 380, 422, 222, 472, 188–190

(56) References Cited

U.S. PATENT DOCUMENTS 4,056,955 A * 11/1977 Glass ..... 70/375 X
5,044,183 A * 9/1991 Neyret ..... 70/379 R X
5,263,348 A * 11/1993 Wittwer ..... 70/379 R
5,640,864 A * 6/1997 Miyamoto ..... 70/379 R
6,058,751 A * 5/2000 Dimig et al. ..... 70/422 X

FOREIGN PATENT DOCUMENTS

| | | |
|---|---|---|
| DE | 4412609 | 10/1995 |
| DE | 195 25 499 A1 | 1/1997 |
| EP | 0611860 | 8/1994 |
| EP | 0659961 | 6/1995 |
| EP | 0769598 | 4/1997 |

* cited by examiner

*Primary Examiner*—Lloyd A. Gall
(74) *Attorney, Agent, or Firm*—Friedrich Kueffner

(57) ABSTRACT

A closing device with a closing cylinder for closing functions to be performed especially on vehicles has a radial recess for the locking and control member that is open toward the exterior of the housing and the locking and control member is exposed in the radially outward direction, but is covered by a leaf-shaped spring. A spring is arranged in the circumferential area of the housing and acts directly on the locking and control member. The control and locking member is arranged radially adjacent to the cylinder portion of the cylinder core being provided with followers. A slide is positioned in a portion of the closing cylinder axially stepped relative to the locking and control member, and an axial connection bridges the spacing between the locking and control member and the slide.

16 Claims, 7 Drawing Sheets

CLOSING DEVICE FOR CLOSING FUNCTIONS IN VEHICLES IN PARTICULAR

BACKGROUND OF THE INVENTION

1. Field of the Invention

The invention relates to a closing device for closing functions to be performed especially on vehicles, with a closing cylinder, wherein the closing cylinder comprises a free bushing and a cylinder core supported therein axially fixed and rotationally and having a cylinder portion comprising followers, and the followers are controllable by insertion of a key and, when the key is removed, lock the cylinder core with the free bushing, with a stationary housing receiving the free bushing in a rotatable fashion in which, however, the free bushing is normally rotationally fixed by a radially spring-loaded locking and control member of an overload interlock, wherein the locking and control member is positioned loose in a radial recess of the housing and, in the normal situation, engages with its radially inner end, because of the radial spring load, a radial recess of the free bushing having a lifting profile, wherein, however, in the overload situation, it moves from this engagement position, counter to its spring load, into a lifted position in the circumferential area of the free bushing, with a working member performing the locking function in the vehicle as well as with a slide rotationally fixedly but slidably connected with the working member, which normally is in a rotationally fixed coupling position with the cylinder core because of a return force, but in the overload situation is decoupled by means of the locking and control member and reaches a locking position which is rotationally fixed in the housing, in which optionally also the working member is locked. When the proper key is completely inserted into the cylinder core and the key is turned, the rotation is transmitted in this device onto a working member which acts on the lock and performs thereat closing functions. When a forced rotation of the closing cylinder by means of burglary tools is carried out, an overload interlock ensures that, even though a rotation of the cylinder core together with the free bushing takes place, this rotation is not transmitted onto the working member. Accordingly, a closing function is not carried out. Moreover, in the overload situation manipulations on the working member are also not possible because they are secured in a locking position; it is secured in the housing. This overload safety ensures that the device is not damaged in the case of forced opening attempts by burglary tools. The device is subsequently ready to be actuated by means of a proper key in the proper way.

2. Description of the Related Art

Devices of the aforementioned kind (DE 44 12 609 A) have been successful in practice but they have the disadvantage of a relatively large axial constructive length. In this device, the overload interlock must be arranged in an axial extension of the cylinder core which is arranged behind the cylinder portion which comprises the followers. The slide is arranged in a recess of the working member which is formed as a lever. In the recess a pressure spring must also be arranged which is supported between the slide and the working member and generates the radial spring load for the locking and control member of the provided overload interlock. The spring load of the overload interlock is thus realized indirectly via the slide. For space reasons, the pressure spring can be only small so that its radial spring load is limited. In order to be able to activate this spring load, the slide has an axial tab which is supported on the locking and control member. The supported tab of the slide is positioned in the same portion as the locking and control member. Moreover, in the same axial portion, the locking surfaces between a locking tongue and an outer sleeve of the housing are provided and, finally, also an inner sleeve of the housing with the radial recess for the locking and control member. The known device has, in addition to the overload interlock, also a catch member in the form of a roller which is forced by a leaf spring into a catch recess of the free bushing. This catch member was axially remote from the overload interlock and could not perform a control function on the slide. The known device was space-intensive and could not exert a sufficiently high spring-load onto the overload interlock.

It is an object of the invention to develop a reliable, space-saving device of the aforementioned kind which is primarily characterized by a minimal axial construction length. This is achieved according to the invention in that the radial recess for the locking and control member is open toward the exterior of the housing and the locking and control member is exposed in the radially outward direction, but is covered by a leaf-shaped spring, wherein the spring is arranged in the circumferential area of the housing and acts directly on the locking and control member, that the control and locking member is arranged radially adjacent to the cylinder portion of the cylinder core being provided with the followers, and that the slide is positioned in a portion of the closing cylinder axially stepped relative to the locking and control member and that an axial connection bridges the spacing between the locking and control member and the slide. According to the invention, the locking and control member can be arranged independently of the location of the slide and can therefore be arranged without problems in that cylinder portion of the cylinder core where also the followers are positioned. This saves axial space within the device. In this cylinder portion the locking and control member is radially outwardly exposed and is covered by a leaf-shaped spring which exerts directly the radial spring force of the overload interlock onto the locking and control member. The slide can be axially remote from the locking and control member. The spring load of the overload interlock which now acts independently of the slide can be as large as desired depending on a corresponding size of the leaf-shaped spring. Moreover, it is now also possible without problems to activate by the same or a separate leaf-shaped spring several locking and control members in the overload interlock, for example, a diametrically correlated pair of members. The spring load of the leaf-shaped spring which acts directly onto the locking and control member is used according to the invention for controlling the slide. For this purpose, an axial connection is provided which bridges the spacing between the side and the locking and control member. This axial connection can be formed in different ways, wherein each of these possibilities has its own inventive importance.

A first possibility for this axial connection resides in that a control member produces an indirect axial connection between the locking and control member and the slide, wherein the control member is arranged radially outside of the housing and connected to a spring of the overload interlock acting on the locking and control member and is moveable together with it. The control member is arranged radially outside of the housing and is formed either as a unitary part of the leaf-shaped spring acting on the locking and control member or comprised of several parts that are however connected to form a constructive unit. When the locking and control member in the overload situation is lifted out of the radial recess of the free bushing, the control member and the spring perform a common radial movement, and this movement is transmitted via the control member onto the slide.

A second possibility for the axial connection resides in that between the locking and control member and the slide a direct positive-locking connection is realized and that the spring of the overload interlock acting on the locking and control member produces by the positive-locking action at the same time the return force which forces the slide into the coupling position with the cylinder core. A direct positive-locking connection between the locking and control member and the slide is provided. In this case, the spring acting on the locking and control member has a double function. On the one hand, it serves as a radial spring-load of the overload interlock, as mentioned above. By means of the positive locking connection, the spring however has at the same time the new function of generating the return force, already mentioned above, which secures the slide in its coupling position. By means of this positive locking connection, the slide is transferred into a locking position in the overload situation in which the slide is fixed in the housing and, at the same time, the working member is secured in the housing. An especially simple embodiment of this positive-locking connection between the slide and the locking and control member results when the positive-locking connection is comprised of an axial pin on the locking control member and a link guide in the slide wherein the pin engages the link guide.

BRIEF DESCRIPTION OF THE DRAWINGS

Further measures and advantages of the invention result from the dependent claims, the following description, and the drawings. The drawings show three embodiments of the invention. It is shown in:

DESCRIPTION OF THE PREFERRED EMBODIMENTS

Figure 1:
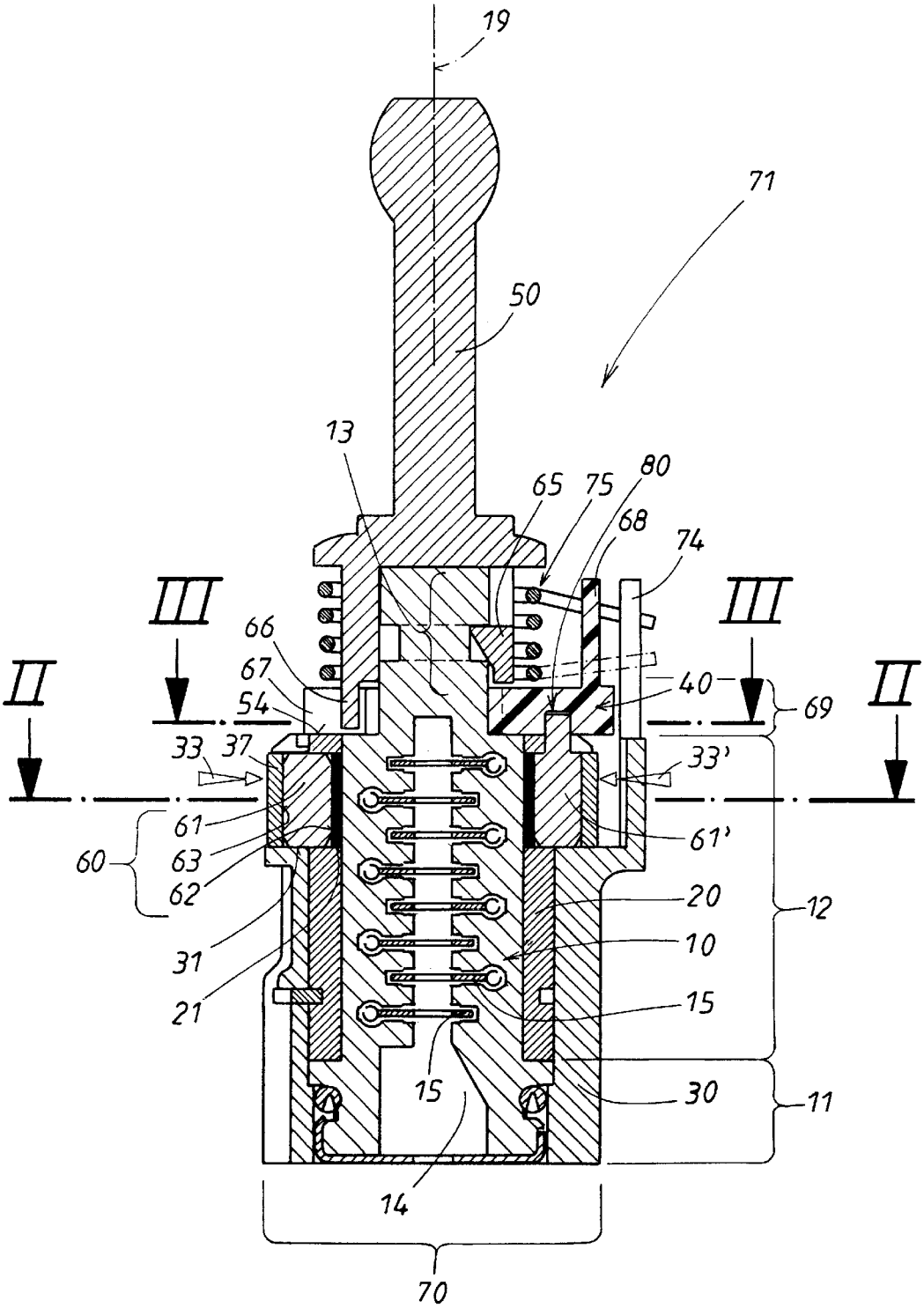
FIG. 1 a schematic longitudinal section of a first embodiment of the device according to the invention along the section I—I of FIG. 2, however, with the key illustrated in FIG. 2 being removed.

The three devices 71, 72, 73 shown in FIGS. 1 through 10 are mounted preferably in doors of vehicles and have with respect to their closing cylinders 70 a substantially identical configuration. The closing cylinder 70 is comprised first of a free bushing 20 and a cylinder core 10 axially secured but rotationally supported therein. The axially secured connection is realized by inner shoulder surfaces between the components. For this purpose, the cylinder core is stepped and comprises a widened cylinder head 11, a cylinder portion 12 comprising spring-loaded followers 15, and a radially stepped cylinder end 13. The cylinder core 10 comprises a key channel 14 for receiving a key 16, illustrated first in FIG. 2 in cross-section. When the key 16 is removed, the followers 15 due to their spring load are forced radially outwardly and engage, as is illustrated at 15' in FIG. 2, a locking channel 22 of the free bushing 20. Now the cylinder core 10 is locked with the free bushing 20.

The free bushing 20 is rotationally supported in a stationary cylindrical housing 30 but is normally prevented from rotation by means of an overload interlock 60 in the housing 30. The free bushing 20 is thus normally secured in the housing 30. On the cylinder end 13 a working member 50 is rotatably supported. In the first device 71 the working member 50 is comprised of a shaft which is seated axially secured by means of a mounting means 65, illustrated in FIG. 1, on the cylinder end 13. The working member 50 engages with a tab 66 a recess 67 of a slide 40, illustrated best in FIG. 3, whose importance and function will be explained in the following. This arrangement realizes the rotationally fixed connection between the working member 50 and the slide 40.

Figure 2:
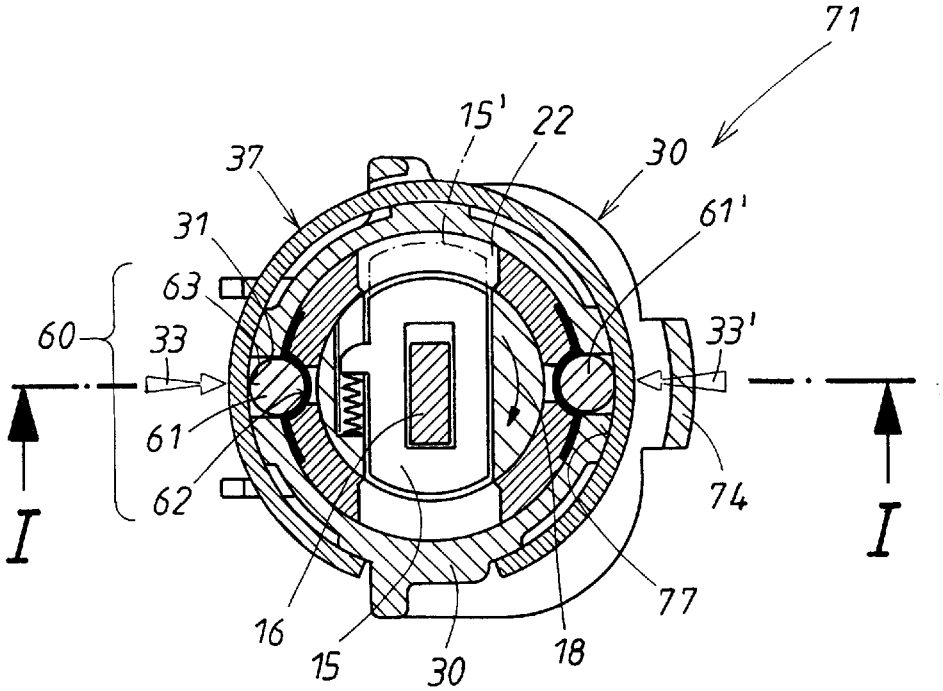
FIG. 2 a first cross-section of the device along the section line II—II of FIG. 1, but after insertion of the proper key.

Generally, the cylinder core 10 is in a zero position illustrated in FIGS. 1 and 2, which is determined, for example, by an impetus spring 75 illustrated in FIG. 1. The impetus spring 75 surrounds with its windings the working member 50 and its two legs enclose between them two axial tabs 68, 74 of the slide 40 and the housing 30, respectively. In the zero position, the proper key 16 can be inserted into the key channel 14 and again removed therefrom. In the inserted state of the key, the followers 15, as illustrated in FIG. 2, are sorted into the circumference of the cylinder core 10. Now the cylinder core 10 is rotatable in the direction of arrow 18 in the free bushing 20. Upon actuation of the key 16, the cylinder core can then be transferred into different angular positions which correspond to certain working positions of the gear wheel 50 and the lock engaged therewith. This rotation 18 of the cylinder core 10 is usually transmitted in the following manner onto the working member of 50.

The already mentioned slide 40 is positioned on an inner end face of a shoulder surface between the cylinder portion 12 and the cylinder end 13 of the free bushing 20 and the housing 30 so that a radial guiding 54 for the slide 40 results. The slide 40 is force-loaded in the direction of arrow 44 of FIG. 3, which in this device 71 is realized in a special way that will be explained in more detail later. In this connection, the coupling surfaces 17, 47 illustrated in FIG. 3 engage one another. The coupling surface 47 belonging to the slide 40 is comprised of a nose pointing into the recess 67 which engages a radial depression 17 in the area of the cylinder end 13. Accordingly, the initial rotational position of the working member 50 is also defined in the zero position of the cylinder core 10. Upon rotation 18 of the cylinder core 10 initiated by the key, the working member 50 is rotated by the cylinder core 10 by means of the engaged coupling 17, 47 and 66, 67 and thus carries out the desired closing functions on the closing members.

The aforementioned overload interlock 60 has the following special configuration illustrated in FIGS. 1 and 2. This includes in the present case two locking and control members 61, 61' whose number can be increased, if needed, or can be replaced by only a single member. In the present case, the two members, as can be seen best in FIG. 2, can be arranged diametrically relative to one another and oriented in a mirror-symmetrical way. They are spring-loaded in the direction of the two arrows 33, 33' in the direction toward the cylinder axis 19 of FIG. 1 which is indicated by a dash-dotted line. Because of their identical configuration, it is therefore sufficient to consider only the locking and control member 61.

The locking and control member 61 is comprised in the present case of a roll body, i.e., a roller. This roller 61 is loosely positioned in a radial recess 31 of the housing 30 which is matched to the roller contour dimensions. The overload interlock 60 also includes a radial recess 21 in the circumferential area of the bushing 20 in which the roller 61 in the normal situation engages with its radially inwardly positioned circumferential area 62 according to FIG. 2.

The aforementioned spring loading 33 is based in the device 71 by a slotted annular spring 37 which, as illustrated in FIG. 2 in the cross-section of the housing 30 in a radial plane, i.e., the section line II—II of FIG. 1, surrounds the housing 30 and is supported by the radially springy annular segments, separate by the ring slot, on the two locking and control members 61, 61'. The corresponding radial recess 31 in the housing is open toward the outer housing surface 77, illustrated in FIG. 2, so that the two locking and control members 61, 61' are exposed with respect of their respective radial outer ends 63 and are covered by the leg ends of the slotted annular spring 37. The annular spring thus acts directly onto the locking and control member 61 or 61' and thus provides the radial spring load 33, 33' of the overload interlock 60. The two locking and control members 61, 61' are positioned radially adjacently to the axial portion which comprises the followers 15. This not only holds true for this device 71 but also for the alternative devices 72 and 73, illustrated in FIG. 7 and 10, respectively. The slide 40 is arranged in all three cases 71 to 73 in an axially stepped portion 69 of the closing cylinder 70, as illustrated in FIGS. 1 through FIG. 7, but between one of the two members 61, 61' and the respective slide 40 an axial connection exists which differ from one another in the devices 71 to 73, respectively.

In the embodiment of the device 71 in FIGS. 1 through 6, a positive-locking connection 80 between the locking and control member 61' and the slide 40 is present. This connection 80 is comprised, as can be seen best in FIG. 3, of an axial pin 81 which engage a link guide 82 of the slide 40. The length of the link guide 82 takes into consideration the degree of the predetermined rotational movement 18 of the cylinder core 10. With this positive-locking connection 80 the spring-load 33', acting directly according to FIG. 2 onto the locking and control member 61', acts indirectly also on the slide 40. Accordingly, the aforementioned return force 44, illustrated in FIG. 3, results which usually secures the aforementioned coupling surfaces 17, 47 in their engagement-effective coupling position.

Figure 4:
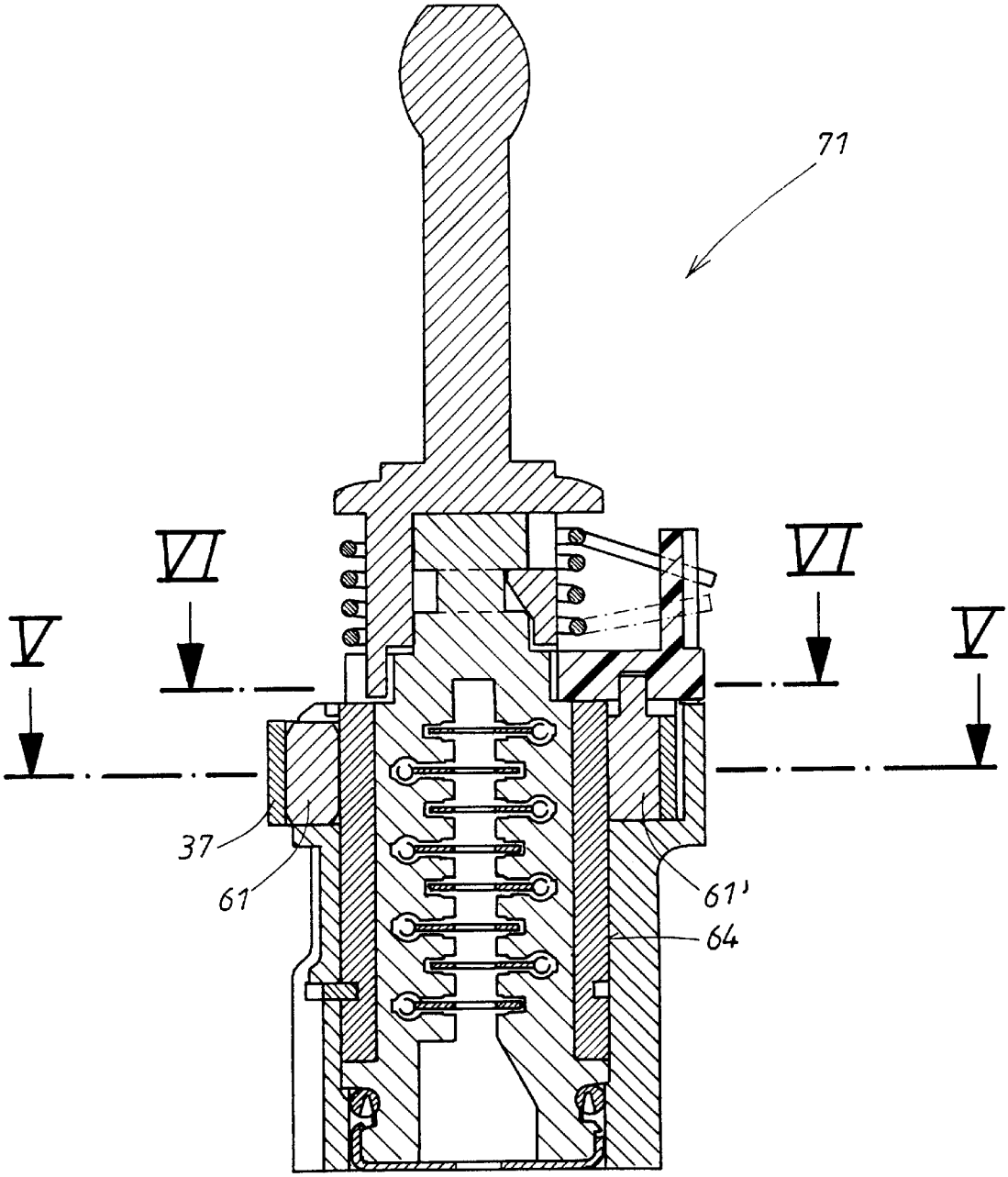
FIG. 4 a longitudinal section corresponding to FIG. 1 through the device, when, because of a forced rotation of a burglary tool, not shown in detail, an overload interlock is moved into a free-wheeling position.
Figure 5:
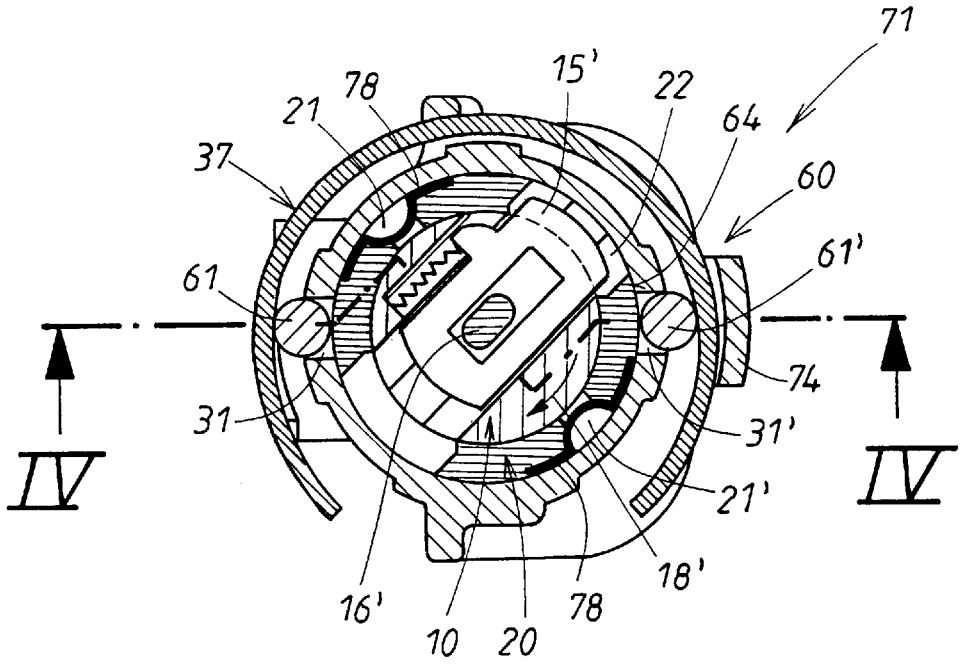
FIG. 5 a cross-section corresponding to that of FIG. 2 along the section line V—V of FIG. 4 of the device with inserted burglary tool, when the device is in the free-wheeling position of FIG. 4.
Figure 6:
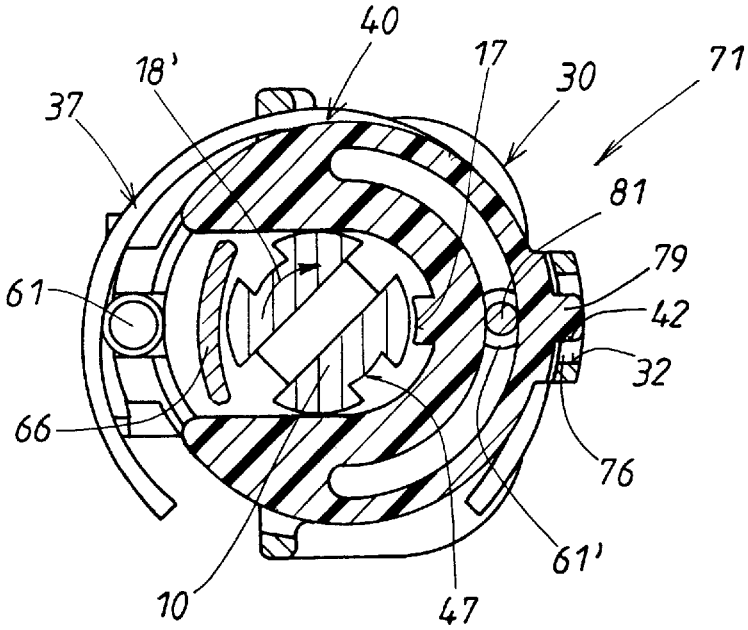
FIG. 6 a second cross-section in analogy to FIG. 3 of the device of FIG. 4 in its free wheeling position along the section line VI—VI shown therein.

This control of the slide 40 by the locking and control member 61, however, not only holds true for the normal situation, but also in the overload situation, as can be seen in FIGS. 4 through 6. When by means of a burglary tool 16', illustrated in FIG. 5, a forced rotation 18' is exerted onto the cylinder core 10 according to FIG. 5, as already mentioned before, the followers 15 are locked in the locking channels 22 of the free bushing 20. Accordingly, both components of the locking cylinder 70, i.e., the cylinder core 10 together with the free bushing 20 are rotated 18' in the housing 30. This is possible because the overload interlock 60 reaches the free wheeling position illustrated in FIG. 5 when during the forced rotation 18' a torque is exerted which surpasses a certain limit value. This limit value is determined by the spring load 33, 33' as well as the profiling, recognizable in FIG. 5, of the two radial recesses 21 or 21' in the free bushing 20. The radial recesses 21, 21' have a suitable lifting profile shape, wherein the rollers 61, 61' rotate out of the recesses when this limit torque has been surpassed. Then the roller 61 is transferred from the engagement position according to FIG. 2, present in the normal situation, into the lifted position, illustrated in FIG. 5, in the overload situation. The two ends of the slotted annular spring 37 are spread apart so that the spring-load 33, 33' of the members 61, 61' is increased. The members 61, 61' roll upon rotation 18' on the circumferential area 64 of the free bushing 20.

In order to be able to withstand the surface pressure for the high spring load 33, 33', the radial recesses 21, 21' are provided in the free bushing 20 with steel inserts 78. In the overload situation the positive-locking connection 80 by means of the pin 81 the spreading movement of the locking member 61' is transferred onto the slide 40, as is illustrated in FIG. 6. In this connection, locking surfaces 42 provided on the slide 40 are brought into engagement with counter locking surfaces 32 of the housing 30. These counter locking surfaces 32 are comprised of a slot 76, illustrated in FIG. 3, of the axial tab 74. The locking surfaces 42 of the slide 40, on the other hand, are comprised of a radial nose 79 of the slide 40. In the overload situation, the slide 40 is thus locked. By means of the described positive-locking engagement between the working member 50 and the slide 40 via the aforementioned tab 66, the working member 50 is also locked according to FIG. 6 in the overload situation. In this locked position the coupling surfaces 17, 47 between the slide 40 and the cylinder core 10 are decoupled; in the overload situation the cylinder core 10 thus rotates freely. There is no entrainment of the working member 50. The device 71 thus does not perform any locking function in the vehicle despite the rotation 18' of the cylinder core 10.

This device 71 has the advantage that the spring load 33, 33' of the overload interlock 60, as has been mentioned already, automatically generates also the return force 44 for the slide 40. Accordingly, a spring additionally provided for returning the slide 40 is thus saved. In the device 71, the leaf-shaped annular spring 37 thus has a double function. Furthermore, it should be noted that, because of the connection 80, in the embodiment of the device 71 the described control movement of the locking and control member 61' between the engagement position of FIG. 2 and the lifted position of FIG. 5 is used for the complete control movement of the slide 40 between its coupling position in FIG. 3 and its locking position of FIG. 5. In the two other devices 72, 73 a partial control of the slide results by means of the locking and control member 61 provided thereat. Because of the substantially identical configuration, it is sufficient to only point of the differences in the devices 72, 73. Otherwise, the description of the device 71 applies.

Figure 9:
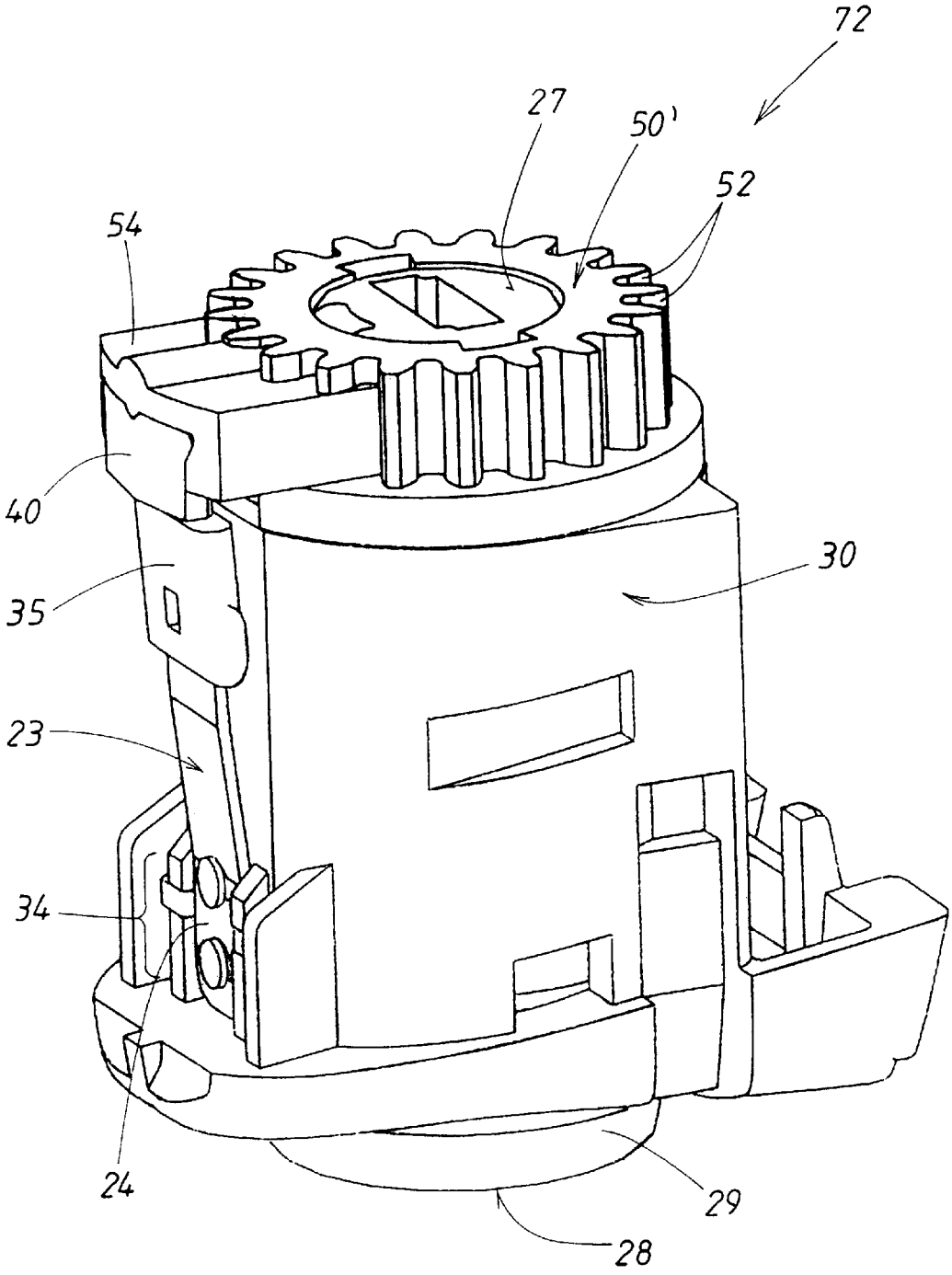
FIG. 9 a perspective view of the device of FIG. 7 according to the invention.

In the devices 72, 73 the working member 50' is comprised of a gear wheel which can be seen best in FIG. 9. The gear wheel 50' is supported on the rear end face of the housing 30 wherein a snap connection 51 or the like is provided for axial connection of the components. The gear wheel 50' comprises a circumferential toothing 52 which engages teeth of further locking members which are not shown in more detail and whose position is illustrated by the arrow 53 in FIG. 7. As can be seen best in FIG. 9, the gear wheel 50' has a radial guide for a slide 40 integrated therein.

Figure 7:
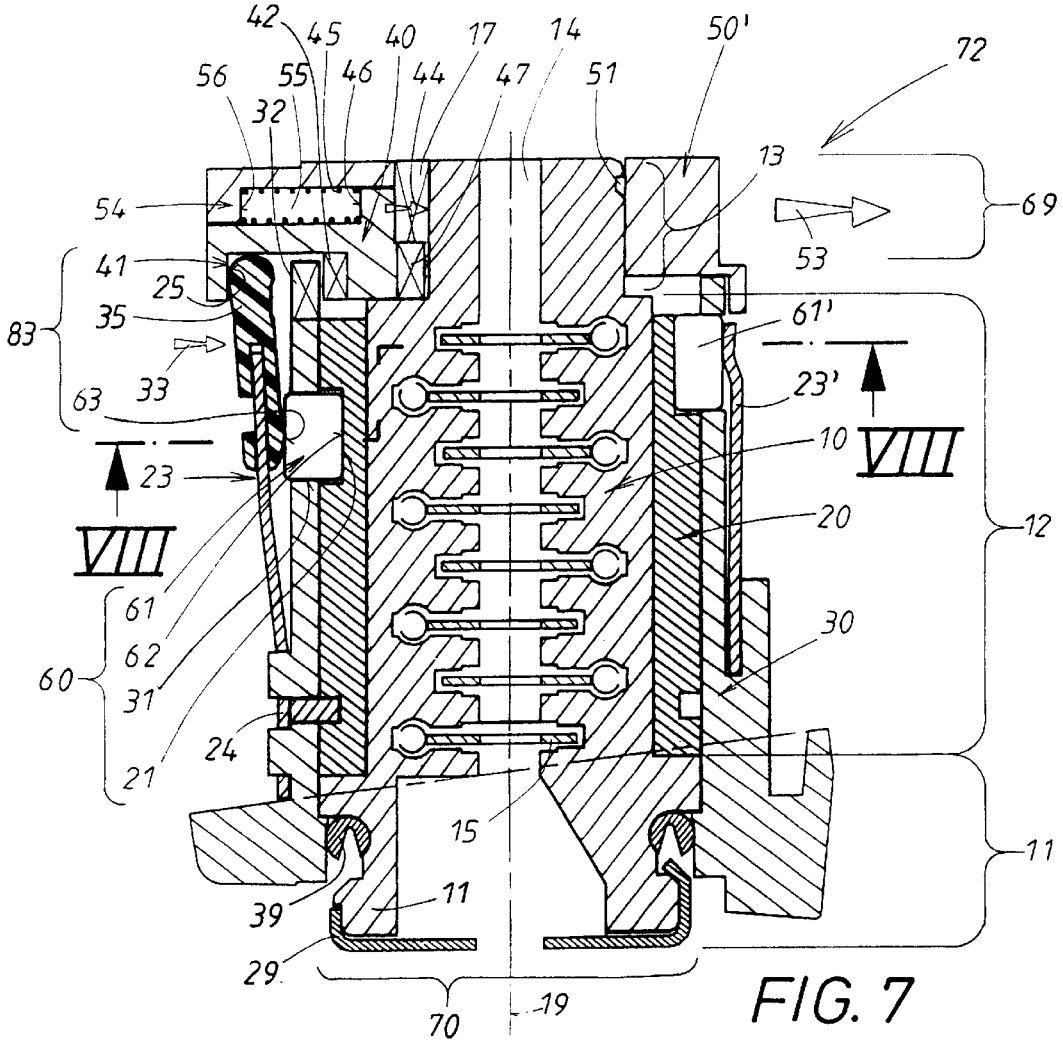
FIG. 7 a longitudinal section of a second embodiment of the device according to the invention, in analogy to FIG. 1, whose section is indicated by the section line VII—VII in FIG. 8, but again with the key being removed.

A receptacle 55 for a pressure spring 45 is provided in the guide 54, as can be seen best in FIG. 7. The pressure spring 45 is supported on the oppositely positioned radial shoulders 46, 56 of the slide 40 and the guide 54, respectively. Accordingly, the slide 40 is force-loaded in the direction of arrow 44 of FIG. 7.

Figure 8:
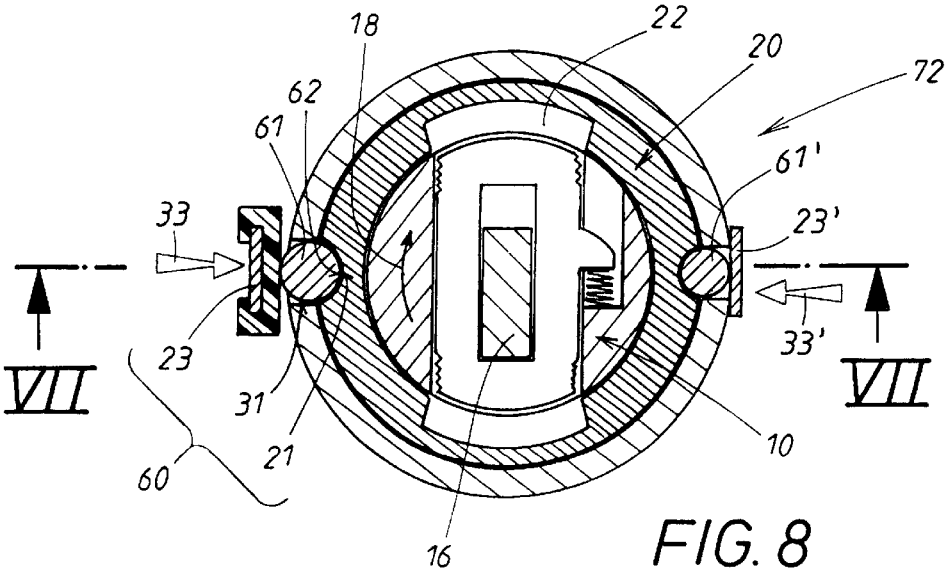
FIG. 8 a cross-section of the device of FIG. 7 along the section line VIII—VIII, after the proper key has been reinserted.

In the second device 72 illustrated in FIG. 7 through 9, an indirect axial connection 83 is used between the locking and control member 61 and the slide 40 for which purpose a control member 23 is used. This control member is comprised in this embodiment of a spring tongue 23 which is arranged radially externally to the housing 30 and produces the spring load 33 of the overload interlock 60 as already described above. This is true also in the same sense for the diametrically oppositely positioned locking and control member 61' which has its own spring tongue 23'. The spring tongues 23, 23' are fastened with their one tongue end 24 in the circumferential area of the housing 30 and are pivotable with their oppositely arranged free spring end 25 in a radial plane of the closing cylinder, which is illustrated by the section plane VII—VII of FIG. 8. One spring tongue 23 is provided with an extension 35 which in this case also performs control functions on the slide 40. The slide 40 projects radially past the cylindrical housing and has a radial shoulder 41 which is engaged from behind by an extension 35 of the control member 23. With the aforementioned pressure spring 45 a constant contact 41 is provided between the extension 35 of the control member 23 and the slide 40.

The control movement of the locking and control member, formed here also as rollers 61 or 61', between the engagement position of FIGS. 7 and 8 and a lifted position, not illustrated in detail but resulting in analogy to FIG. 5, is also transmitted in this case by the axial connection 83 onto the shoulders 40. This is realized by the spring tongue 23 which is supported on the outer end 63 of the roller 61. In this connection, the locking surfaces 32, 42 provided also between the slide 40 and the housing 30 reach their locking position. The gear wheel 50 is now rotationally locked. The return movement of the slide 40 from such a locking position into the coupling position of FIG. 7 is realized actively by a pressure spring 45 but in cooperation with the return movement of the spring tongue 23.

As can be seen in FIG. 7, the locking position 32 for the slide 40 in the housing 30 is arranged radially closer to the cylinder axis 19 than the afore described contact location 41 between the slide 40 and the free tongue end 25. The gear wheel 50' is positioned, as is shown in FIG. 9, at the inner end 27 of the cylinder core 10. It is supported rotatably, coaxial to the cylinder axis 19, on the cylinder pin 13 provided thereat. The fastening location 34 of the tongue 23 is positioned on the oppositely arranged outer end portion 28. The cylinder head 11 provided there is covered by a dust cap 29. An elastic annular seal 39 in an annular groove between the cylinder head 11 and the housing 30 provides protection against dirt.

It is understood that the number of the rollers 61, 61' determining the torque limit and the corresponding spring tongues 23, 23' can be as desired. Several such tongues 23, 23' can also be produced by a slotted spring ring which allows a common fastening of all tongues in the circumferential area of the housing 30. Instead of a bendable spring tongue 23 it is also possible to employ a pivotable arm which is spring-loaded by spring means in the direction of the cylinder axis 19 and generates the spring load which is described by the arrow 33 or 33'.

Figure 10:
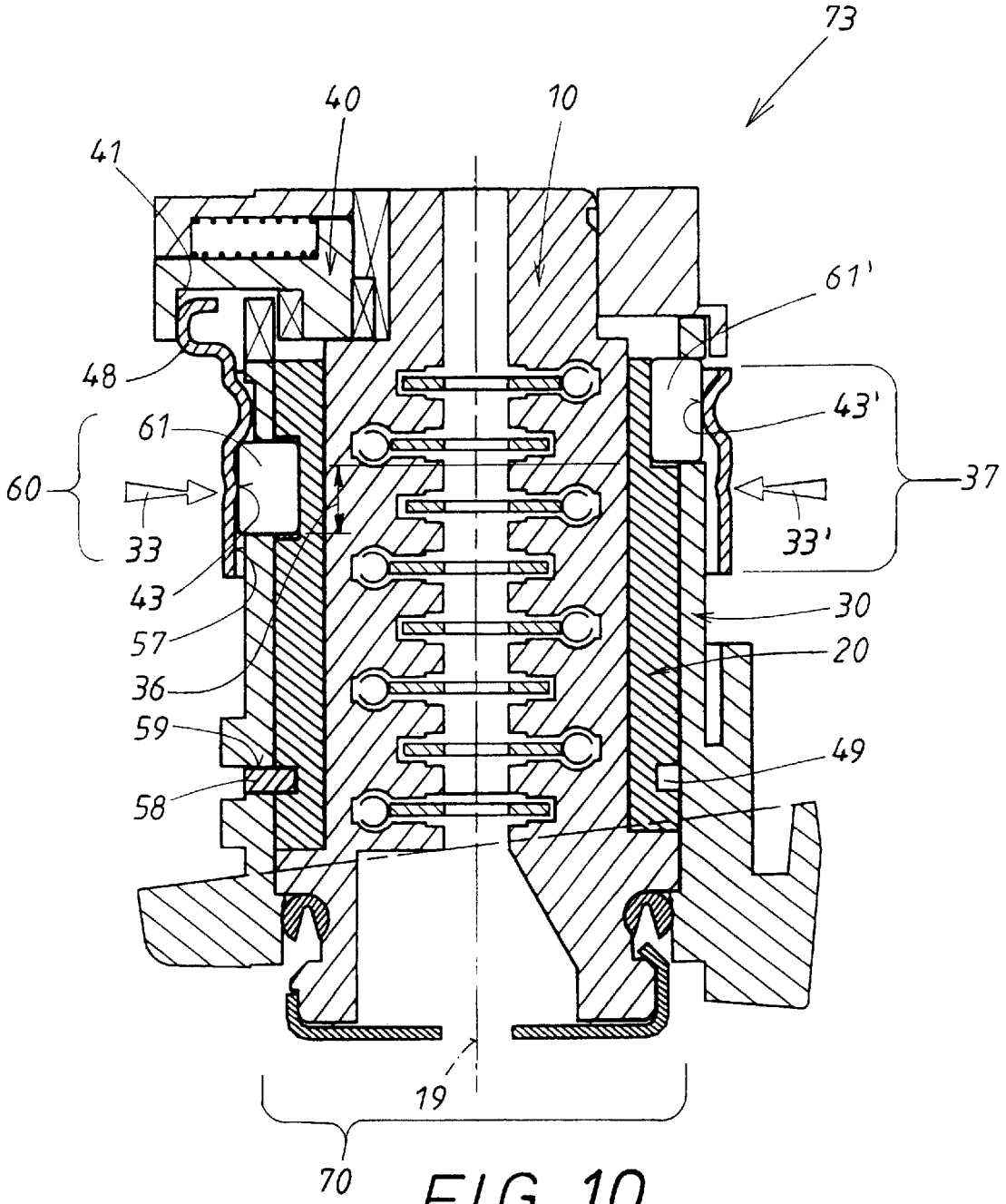
FIG. 10 an axial section of a third device according to the invention, also illustrated only schematically, with the key being removed, in a variant of the device illustrated in FIG. 7.

The third embodiment of the device 73 according to the invention, illustrated in FIG. 10, is partly identical to the second embodiment according to FIGS. 7 and 8 and partially identical to the first embodiment according to FIGS. 1 through 6. Therefore, inasmuch as the same reference numerals are being used, the above description applies in this respect. It is sufficient to point out the differences. The radial spring force 33, 33' is generated also in this case by a slotted annular spring 37 and transmitted via the support location 43, 43' onto the two members 61, 61', wherein one of them 61 again carries out a control function.

In the overload situation, the annular spring 37 widens radially. It "breathes" upon transition from the normal situation into the overload situation. The annular spring 37 has at its annular inner surface 57, as illustrated in FIG. 10, various support locations 43, 43' for the individual locking members 61, 61'. Moreover, the annular spring 37 is provided with an axial projection 48 which, in the way described above in connection with the previous embodiment in an analog manner, cooperates on the contact location 41 with the slide 40. The free bushing 20 has, as shown in FIG. 6, a circumferential groove 49 in which a spring ring 58 or the like engages which itself is positioned in a radial receptacle 59 of the housing 30. This spring ring 58 provides an axial connection between the stationary housing 30 and the free bushing 20 rotatable therein in the overload situation.

| list of reference numerals | |
|---|---|
| 10 | cylinder core |
| 11 | cylinder head of 10 |
| 12 | cylinder portion of 10 with 15 |
| 13 | cylinder end of 10 |
| 14 | key channel for 16 in 10 |
| 15 | follower in 12 (sorted position) |
| 15' | locking position of 15 (FIG. 2) |
| 16 | key for 10 |
| 16' | burglary tool (FIG. 5) |
| 17 | coupling surface of 10, radial depression |
| 18 | key rotation of 10 (normal situation) |
| 18' | forced rotation of 10 and 20 (overload situation, FIG. 5) |
| 19 | cylinder axis of 10 |
| 20 | free bushing |
| 21, 21' | radial cutout in 20 |
| 22 | locking channel in 20 for 15 |
| 23 | control member, spring tongue, leaf-shaped spring |
| 23' | second spring tongue |
| 24 | fixed tongue end of 23 |
| 25 | free end of 23 |
| 26 | |
| 27 | inner end of 10 |
| 28 | outer end portion of 10 |
| 29 | dust cap 12 (FIG. 7) |
| 30 | housing |
| 31, 31' | radial penetration in 30 for 61, 61 |
| 32 | counter locking surface on 30 for 40 |
| 33, 33' | arrow of spring load of 23 or 23' |
| 34 | fastening location for 24 |
| 35 | extension of 23 |
| 36 | axial shoulder between 61 and 61' (FIG. 10) |
| 37 | slotted annular spring (FIG. 2 and 10) |
| 38 | |
| 39 | annular seal between 12, 30 (FIG. 7) |
| 40 | slide |
| 41 | radial shoulder for 25, contact location |
| 42 | locking surface on 40 for 30 |
| 43, 43' | support location of 37 on 61, 61' (FIG. 10) |
| 44 | arrow of return foresaw 40 (FIG. 3) |
| 45 | pressure spring for 44 |
| 46 | radial shoulder for 45 on 40 |
| 47 | coupling surface of 40 |
| 48 | axial projection on 37 for 40 (FIG. 10 |
| 49 | circumferential groove in 20 (FIG. 10) |
| 50 | working member, pin (FIGS. 1 through FIG. 6) |

-continued

Figure 3:
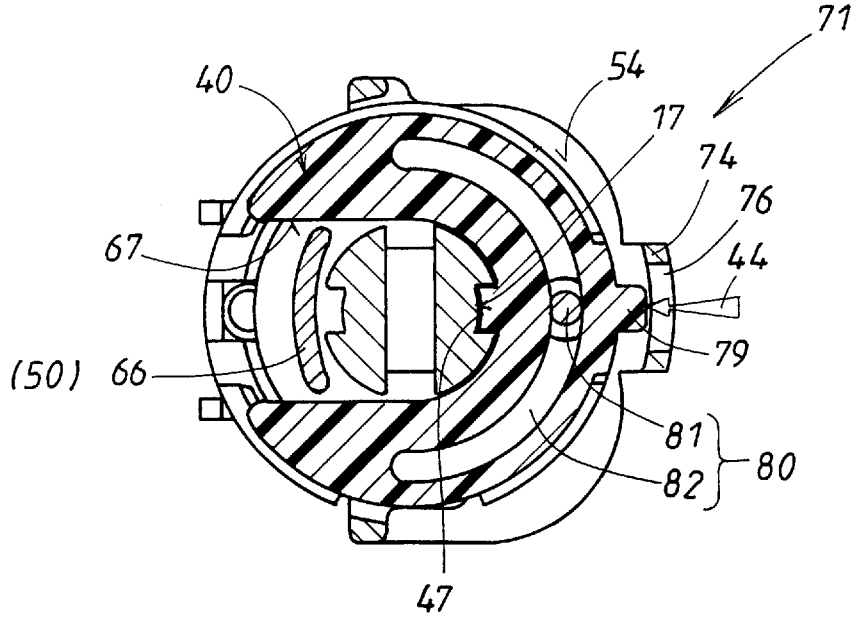
FIG. 3 a second cross-section of the device of FIG. 1 along the section line III—III shown therein.

| list of reference numerals | |
|---|---|
| 50' | working member, gear wheel (FIGS. 7 through 9) |
| 51 | snap connection between 10, 50' (FIG. 7 through 10 |
| 52 | circumferential toothing on 50 |
| 53 | arrow of closing members on 50 |
| 54 | radial guide of 40 on 50, 50' |
| 55 | receptacle for 45 in 54 |
| 56 | radial shoulder for 45 on 54 |
| 57 | inner annular surface of 37 (FIG. 10) |
| 58 | spring ring (FIG. 10) |
| 59 | radial receptacle in 30 (FIG. 10) |
| 60 | overload interlock |
| 61, 61' | locking and control member for 60, roller |
| 62 | radial inner end of 61 |
| 63 | radial outer end of 61 |
| 64 | circumferential area of 20 |
| 65 | mounting means between 13, 50 (FIG. 1 |
| 66 | tab of 50 (FIGS. 1, 3) |
| 67 | cutout in 40 (FIGS. 1, 3) |
| 68 | tab on 40 (FIG. 1) |
| 69 | portion of 40 at 70 (FIGS. 1, 7) |
| 70 | closing cylinder |
| 71 | first device |
| 72 | second device |
| 73 | third device |
| 74 | tab on 30 (FIG. 1) |
| 75 | impetus spring |
| 76 | slot for 32 in 74 (FIG. 3 |
| 77 | outer housing surface (FIG. 2) |
| 78 | steel insert in 21, 21' (FIG. 5) |
| 79 | radial nose for 42 on 40 (FIG. 2) |
| 80 | positive-locking axial connection in 71 (FIGS. 1, 3) |
| 81 | axial pin on 61' (FIG. 3) |
| 82 | link guide for 81 in 40 (FIG. 3) |
| 83 | indirect connection between 40, 61 in 72 or 73 (FIG. 7) |

What is claimed is:

1. Closing device (71, 72, 73) for closing functions to be performed especially on vehicles, with a closing cylinder (70), wherein the closing cylinder (70) comprises a free bushing (20) and a cylinder core (10) supported therein axially fixed and rotationally and having a cylinder portion (12) comprising followers (15), and the followers (15) are controllable by insertion of a key (16) and, when the key (16) is removed, lock the cylinder core (10) with the free bushing (20), with a stationary housing (30) receiving the free bushing (20) in a rotatable fashion in which, however, the free bushing (20) is normally rotationally fixed by a radially spring-loaded (33) locking and control member (61; 61') of an overload interlock (60), wherein the locking and control member (61; 61') is positioned loose in a radial recess (31; 31') of the housing (30) and, in the normal situation, engages with its radially inner end (62), because of the radial spring load (33), a radial recess (21, 21') of the free bushing (20) having a lifting profile, wherein, however, in the overload situation, it moves from this engagement position, counter to its spring load (33), into a lifted position in the circumferential area (64) of the free bushing (20), with a working member (50) performing the locking function in the vehicle as well as with a slide (40) rotationally fixedly but slidably connected with the working member (50, 50'), which normally is in a rotationally fixed coupling position with the cylinder core (10) because of a return force (44), but in the overload situation is decoupled by means of the locking and control member (61; 61') and reaches a locking position which is rotationally fixed in the housing (30), in which optionally also the working member (50; 50') is locked (32, 42) and, wherein the radial recess (31; 31') for the locking and control member (61; 61') is open toward the exterior of the housing and the locking and control member (61; 61') is exposed in the radially outward direction, but is covered by a leaf-shaped spring (37; 23, 23'), wherein the spring (37; 23, 23') is arranged in the circumferential area of the housing (77) and acts directly on the locking and control member (61; 61'), that the control and locking member (61; 61') is arranged radially adjacent to the cylinder portion (12) of the cylinder core (10) being provided with the followers (15), and that the slide (40) is positioned in a portion (69) of the closing cylinder (70) axially stepped relative to the locking and control member (61) and that an axial connection (80, 83) bridges the spacing between the locking and control member (61; 61') and the slide (40).

2. The device (71) according to claim 1, wherein between the locking and control member (61') and the slide (40) a direct positive-locking connection (80) is realized and that the spring (37) of the overload interlock (60) acting on the locking and control member (61') produces by the positive-locking action (80) at the same time the return force (44) which forces the slide (40) into the coupling position with the cylinder core (10).

3. The device (71) according to claim 2, wherein the positive-locking connection (80) is comprised of an axial pin (81) on the locking control member (61') and a link guide (82) in the slide (40) wherein the pin (81) engages the link guide (82).

4. The device (71, 72, 73) according to claim 1, wherein the axial connection (80; 83) between the locking and control member (61; 61') and the slide (40) is arranged at the same portion of the closing cylinder (10) as the coupling means (17, 47) between the slide (40) and the cylinder core (10) or the locking means (42, 32) between the slide (40) and the housing (30).

5. The device (71, 72, 73) according to claim 1, wherein, for increasing the surface pressure exerted by the spring (37) of the overload interlock (60) onto the locking and control member (61; 61'), the radial recess (21) in the free bushing (20) is provided with a steel insert (78).

6. The device (72, 73) according to claim 1, wherein a control member (23) produces an indirect axial connection (83) between the locking and control member (61) and the slide (40)

wherein the control member (23) is arranged radially outside of the housing (30) and connected to a spring (23) of the overload interlock (60) acting on the locking and control member (61) and is moveable together with it.

7. The device (72, 73) according to claim 6, wherein the slide (40) radially projects past the cylindrical housing (30), and that the control member (23) engages behind a radial shoulder (41), and that the slide (40) in the contact direction of its contact location (41) is force-loaded (44) by the control member (23).

8. The device (72, 73) according to claim 6, wherein the locking location (42, 32) between the slide (40) and the housing (30) is arranged radially closer to the cylinder axis (19) than the contact location (41) between the slide (40) and the control member (23).

9. The device (72, 73) according to claim 6, wherein the control member (23) is comprised of an extension (35) of a spring tongue (23), and that the tongue (23) is pivotable in a radial plane of the closing cylinder (70) and springy (33) in the direction of the cylinder axis (19).

10. The device (71, 73) according to claim 1, wherein the spring of the overload interlock (60) is a slotted annular spring (37) which surrounds the housing (30) in a radial plane, and that the annular spring (37) is supported with a ring segment on the locking and control member (61; 61') and exerts the radial spring force onto the locking and control member (61; 61').

11. The device (73) according to claim 10, wherein the annular spring (37) comprises an axial projection (48) which cooperates with the slide (40).

12. The device (71, 72, 73) according to claim 1, wherein the overload interlock (60) comprises two or more locking and control members (61; 61') with own radial recesses (31, 31') in the housing (30) and with own radial cutouts (21, 21') in the free bushing (20).

13. The device (71, 72, 73) according to claim 12, wherein the individual locking members (61, 61') are uniformly distributed about the circumference of the closing cylinder and that for two locking and control members (61, 61') they are diametrically positioned relative to one another.

14. The device (72, 73) according to claim 12, wherein the different locking and control members (61, 61') on the closing cylinder are arranged with axial spacing (36) to one another.

15. The device (72,73) according to claim 1, wherein the working member is a gear wheel (50') which is rotationally supported on the stepped inner end (13) of the cylinder core (10), and that a radial guide (54) for the slide (40) is integrated in the gear wheel (50').

16. The device according to claim 1, wherein the locking and control member (61; 61') is a roller (61) or a ball.

* * * * *